US005217638A

United States Patent [19]

Hattori et al.

[11] Patent Number: 5,217,638

[45] Date of Patent: Jun. 8, 1993

[54] ELECTROVISCOUS FLUID

[75] Inventors: Eiji Hattori; Yasuo Oguri, both of Yokohama, Japan

[73] Assignee: Mitsubishi Kasei Corporation, Tokyo, Japan

[21] Appl. No.: 595,403

[22] Filed: Oct. 11, 1990

Related U.S. Application Data

[63] Continuation-in-part of Ser. No. 350,692, May 9, 1989, abandoned.

[30] Foreign Application Priority Data

May 13, 1988 [JP] Japan ..... 63-116631

[51] Int. Cl.[5] ..... C10M 171/00; C09K 3/00

[52] U.S. Cl. ..... 252/74; 252/73; 252/75; 252/572

[58] Field of Search ..... 252/572, 73, 74, 75

[56] References Cited

U.S. PATENT DOCUMENTS

| | | | |
|---|---|---|---|
| 3,047,507 | 7/1962 | Winslow | 252/75 |
| 3,427,247 | 2/1969 | Peck | 252/75 |
| 3,970,573 | 7/1976 | Westhaver | 252/75 |

*Primary Examiner*—Christine Skane

*Attorney, Agent, or Firm*—Oblon, Spivak, McClelland, Maier & Neustadt

[57] ABSTRACT

An electroviscous fluid comprising an electrical insulating liquid and fine particles dispersed therein, wherein the fine particles are spherical particles containing an electrolytic solution, obtained by hydrolysis and polycondensation of a metal alkoxide or its derivative.

10 Claims, 2 Drawing Sheets

ELECTROVISCOUS FLUID

This application is a continuation-in-part of application Ser. No. 07/350,692, filed May 9, 1989, now abandoned.

The present invention relates to an electroviscous fluid.

The electroviscous fluid is a fluid showing a so-called electroviscous effect, whereby the apparent viscosity changes quickly and reversibly by the action of applied voltage (off, on, a change in the voltage).

Heretofore, a fluid obtained by vigorously stirring an electrical insulating liquid, fine particles containing or having adsorbed ions and a small amount of water, has been known as one of electroviscous fluids.

The electroviscous effect in such fluid is considered to be brought about as follows.

Namely, by the vigorous stirring, water transfers into fine particles to form an electrolytic solution, and when a voltage is applied, ions in the electrolytic solution are displaced and localized in the fine particles, whereby the particles will be polarized. The respective fine particles flocculate to one another by electrostatic attraction due to the polarization, whereby electroviscous effect will be brought about. There is no particular restriction as to fine particles in such viscous fluid, so long as they are capable of maintaining a dispersed state constantly. Either inorganic or organic fine particles may be employed.

Heretofore, pulverized silica particles have been used as inorganic fine particles, since they are readily available. In a cratch, hydrauric valve, vibration damping device, vibrator or the like wherein the electroviscous fluid is used, it is common to utilize the viscosity change of the fluid when the fluid passes through a space between a pair of electrodes for the application of an electric field. Accordingly, abrasion between the particles as the dispersed phase and the wall of the apparatus creates a problem.

In this respect, the problem of such abrasion is serious with an electroviscous fluid in which pulverized silica particles are employed as the dispersed phase, since the silica particles have sharp edges. An improvement has been desired to solve the problem.

In an electroviscous fluid, particles form a cross-linking structure when a voltage is applied across the electrodes. Accordingly, in the case of pulverized particles, sharp edges of the particles are in contact with one another, whereby there has been a drawback that the dielectric strength tends to be low.

It is an object of the present invention to provide an electroviscous fluid to overcome the above-mentioned problems.

According to the present invention, the object can be readily accomplished by an electroviscous fluid comprising an electrical insulating liquid and fine particles dispersed therein, wherein the fine particles are spherical particles containing an electrolytic solution, obtained by hydrolysis and polycondensation of a metal alkoxide or its derivative.

Now, the present invention will be described in detail with reference to the preferred embodiments.

The electroviscous fluid of the present invention employs fine particles dispersed in an insulating liquid, which are spherical particles having an average particle size of from 0.05 to 2μm obtained by hydrolysis and polycondensation of a metal alkoxide or its derivative. As the metal alkoxide, various alkoxides disclosed in "Metal Alkoxides, edited by D. C. Bradley. R. C. Mehrotra, D. P. Gaur, Academic Press, 1978" may be employed. A preferable alkoxide is composed of lower alkoxy groups of one type or in combination, such as methoxy, ethoxy, propoxy and/or butoxy. Typical examples include alkoxides of e.g. Si, Ti, Ta and Zr, and composite alkoxides of e.g. Ba-Ti, Sr-Ti, Pb-Ti, Pb-Ti-Zr, Ti-Ta and Li-Nb.

The hydrolysis of a metal alkoxide is usually conducted by mixing an alcohol solution of an alkoxide with an aqueous alcohol solution. By properly adjusting the hydrolyzing rate, an amorphous substance of metal oxide can be precipitated substantially in the form of spherical particles. The hydrolyzing rate can usually be adjusted by controlling e.g. the molar ratios and concentrations of the alkoxide and water in the reaction system, and the amount of the catalyst (such as an alkali or acid) for hydrolysis which may be added as the case requires. The conditions to obtain spherical particles can not generally be defined, since they vary depending upon the type of the alkoxide. However, in the case of e.g. $Si(OC_2H_5)_4$, $Ti(OC_2H_5)_4$ or $Zr(OC_2H_5)_4$, the molar ratio of water to the alkoxide is usually from 1 to 150, preferably from 1 to 100, the concentration of the alkoxide is usually from 0.05 to 10 mol/l, preferably from 0.05 to 5 mol/l, and the concentration of water is usually from 0.1 to 20 mol/l, preferably from 0.1 to 10 mol/l.

Figure 1:
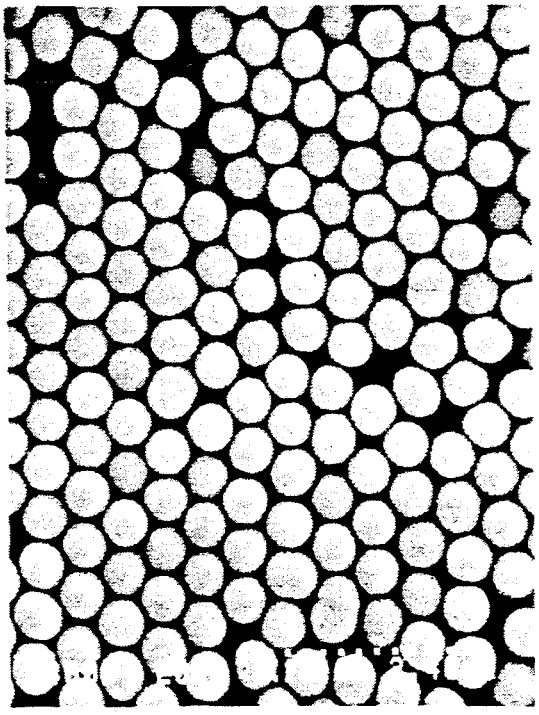
FIG. 1 is a scanning electron microscopic photograph showing the structure of spherical silica particles obtained in the Examples given hereinafter.

FIG. 1 shows a scanning electron microscopic photograph (10,000 magnification) of spherical particles of silica obtained by hydrolysis of $Si(OC_2H_5)_4$ in Example 1. As is evident from the Figure, each particle is spherical, and the particle size distribution is sharp.

Spherical silica particles are obtained by separating the solid content from the alcohol solution by filtration or centrifugal separation, followed by drying by means of e.g. a rotary evaporator and have an average particle size within a range of from 0.05 to 2μm.

The above spherical particles contain an electrolytic solution, and the electroviscous effect will be obtained by ions in the solution in accordance with the principle as described above.

There is no particular restriction as to the electrolyte constituting the electrolytic solution so long as it dissociates ions in a polar solvent such as water. For example, the electrolyte may be an inorganic compound such as $NH_3$, NaOH, NaCl, LiCl, $B_2O_3$, $Ca(OH)_2$, $MgSO_4$, $Fe(NO_3)_2$ or an ionic surfactant such as sodium sulfonate, sodium carboxylate, sodium alkylbenzene sulfonate, sodium polystyrene sulfonate, a calcium salt of fatty acid or a condensation product of naphthalene sulfonic acid with formalin.

Any polar solvent may be used as the solvent constituting the electrolytic solution, so long as it is capable of adequately dissolving the electrolyte used.

The concentration and the content of the electrolytic solution may be suitably selected within the respective ranges not to conduct electricity when the electric field is applied. The concentration is selected usually within a range of from 0.1 to 90% by weight, preferably from 5 to 50% by weight. The content is selected usually within a range of from 0.1 to 20% by weight, preferably from 1 to 10% by weight.

As described above, the hydrolysis and polycondensation of a metal alkoxide can be conducted in the presence a catalyst such as $NH_3$. The diameters of spherical particles thus obtained are approximately uniform, and the particle size distribution i.e. the standard deviation from the diameter is not more than 1.2 , preferably from 1.01 to 1.10 . In such case, the catalyst can be used by itself as the electrolyte. Namely, after the hydrolysis and polycondensation of a metal alkoxide, spherical silica particles are separated from the alcohol solution and dried. If this drying is not completely conducted but conducted to such an extent that the weight reduction by heating in air upto 200° C. would be from 0.1 to 20% by weight, preferably from 1 to 10% by weight, it is possible to obtain spherical particles containing an electrolytic solution within the above-mentioned range. The above-mentioned weight reduction under heating is a value obtained by a differential thermal analysis at a temperature raising rate of 10° C./min.

It is of course possible that the above drying or the preceding washing with water is completely conducted, and an electrolytic solution is subsequently introduced. In such case, it is preferred to use a solvent having a boiling point higher than water, as the polar solvent constituting the electrolytic solution. Namely, with an electroviscous fluid wherein a low boiling solvent such as water is used, there is a problem that when it is used over a long period of time at a high temperature or in an environment where heat is generated by a high shearing force, the solvent will be evaporated or diffused, whereby no adquate electroviscous effect tends to be obtained. By using a solvent having a high boling point, such problem can be solved at once. The polar solvent having a high boling point to be used for this purpose includes glycol (such as ethylene glycol and propylene glycol) and ethanolamine. Among them, ethylene glycol is preferably employed.

To impregnate the particles with the electrolytic solution, the spherical particles, the electrolyte, the polar solvent and the electrical insulating liquid may be mixed for a few hours in e.g. a ball mill, or spherical particles may be impregnated in an electrolyte solution.

As the electrical insulating liquid, a liquid capable of dispersing the spherical particles in a stabilized state, which has a high insulation resistance and which does not dissolve the electrolyte solution, is used. Specifically, it is suitably selected from silicone oil, trans oil, engine oil, an ester, paraffin, an olefin and an aromatic hydrocarbon.

The amount of the spherical particles in the electroviscous fluid is usually from 5 to 50%, preferably from 10 to 40%.

For dispersing, a ball mill or a usual mixing and dispersing machine such as a ultrasonic dispersing machine, may be used.

The electroviscous effect may be measured by using a coaxial double cylinder type rotary viscometer, and an increase in the shearing stress is measured at shearing speed (162 $sec^{-1}$–365 $sec^{-1}$) when a voltage is applied across outer and inner cylinders, and the increase is converted to the change in viscosity.

With the electroviscous fluid, the fluidity can be controlled by the applied voltage. Therfore, its development in the mechatronics field of computer control, is expected. Some examples of the practical application will be mentioned. In the automobile industry, it may be applied to a cratch, a torque converter, a valve, a shock absorber, a brake system or a power steering. Further, in the industrial robot field, it is now being applied to various actuators.

Now, the present invention will be described in further detail with reference to Examples. However, it should be understood that the present invention is by no means restircted to such specific Examples.

EXAMPLE 1

Solution A obtained by dissolving 186.0 g of $Si(OC_2H_5)_4$ (guaranteed reagent grade) in 670.7 g of ethyl alcohol (guaranteed reagent grade) and solution B obtained by dissolving 223.6 g of a 28% $NH_4OH$ aqueous solution and 173.9 g of water in 1,999.5 g of ethyl alcohol, were mixed to precipitate silica particles having a diameter of 0.56μm. The standard deviation from the particle diameter was 1.05 . The particles were separated from this slurry by a conventional method and vacuum-dried at 100° C. for one hour to obtain particles in a power form. The particles contained $NH_3$(1.3 wt % ), water (4.1 wt % ) and ethanol (0.6 wt % ), and the weight reduction was 6% when it was heated in air at 200° C. Then, 30.1 g of the particles were added to 32.8 g of silicone oil (Toray silicone SH200, 10cs), and the mixutre was dispersed and mixed for 12 hours in a ball mill.

Figure 2:
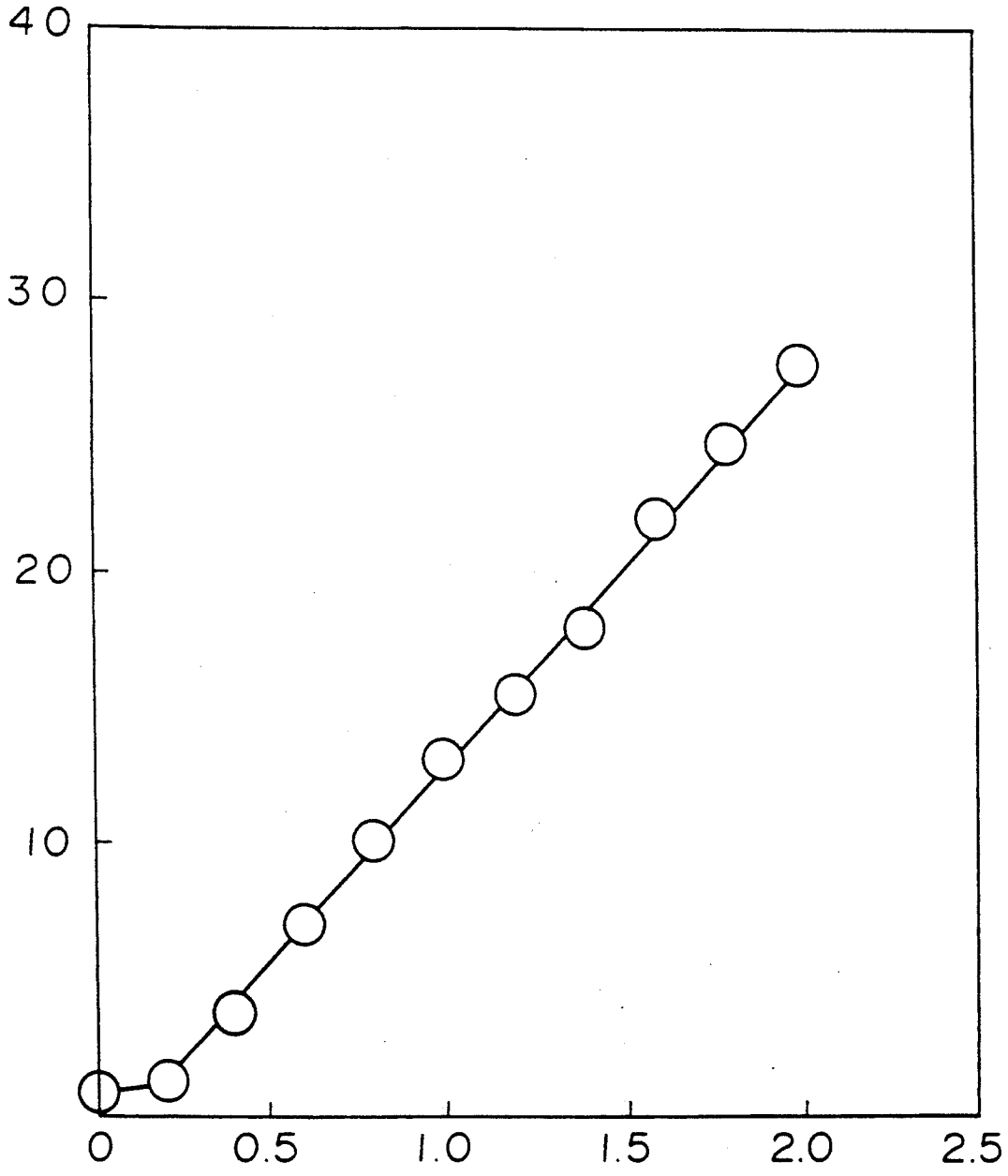
FIG. 2 is a graph showing the viscosity-increasing effect of the electroviscous fluid of Example 1 relative to the applied electric field.

With respect to the electroviscous fluid of the present invention thus obtained, the shearing stress was measured by using a coaxial double cylinder type rotary viscometer (electrode distance: 1 mm, temperature: 25° C.) at shearing speed (162 $sec^{-1}$) when a voltage was applied across the inner and outer cylinders. The results thereby obtained are shown in FIG. 2. It is evident that when an electric field 2 kv/mm was applied, the initial viscosity of 1.7 poise increased to a level of 28 poise. This liquid was left to stand at room temperature, and the measurement was conducted 10 days layer, whereby no change in the properties was observed.

EXAMPLE 2

Spherical silica particles as used in Example 1 were preliminarily heated at 250° C. for 16 hours to adequately remove $NH_3$, water and ethanol to obtain 40 g of particles. Then, 48 g of a 5.5% NaOH aqueous solution was added thereto, and the mixture was vacuum-dried at 100° C. for one hour to obtain particles in a power form. The particles contained NaOH (5.2 wt % ) and water (9.7 wt % ), and the weight reduction was 9.7% when heated in air at 200° C. Then, 30.1 g of the particles were added to 32.8 g of silicone oil (Toray silicone SH200, 10cs), and the mixture was dispersed and mixed for 12 hours in a ball mill. The initial viscosity of the crude thus obtained was 1.5 poise, and when an electric field of 2 kv/mm was applied, the viscosity increased to 16 poise (162 $sec^{-1}$).

EXAMPLE 3

Spherical silica particles as used in Example 1 were preliminarily heated at 250° C. for 16 hours to adequately remove $NH_3$, water and ethanol. Then, 10.0 g of silica particles thus obtained and 0.9 g of aqueous ammonia ($NH_3$ concentration: 25%) were added to 18.7 g of silicone oil (Toray silicone SH200, 10cs), and the mixture was dispersed and mixed for 12 hours in a ball mill. the initial viscosity of the fluid thus obtained was 0.2 poise, and when an electric field of 1.8 kv/mm was applied, the viscosity increased to 22 poise (162 $sec^{-1}$).

EXAMPLE 4

Spherical silica particles as used in Example 1 were preliminarily heated at 250° C. for 16 hours to adequately remove $NH_3$, water and ethanol. Then, 10.0 g of the silica particles thus obtained and 1.3 g of an aqueous NaOH solution (NaOH concentration: 44%) were added to 18.7 g of silicone oil (Toray silicone SH200, 10cs), and the mixture was dispersed and mixed for 12 hours in a ball mill. The initial viscosity of the fluid thus obtained was 0.3 poise, and when an electric field of 2 kv/mm was applied, the viscosity increased to 16 poise (162 $sec^{-1}$).

EXAMPLE 5

Spherical silica particles as used in Example 1 were preliminarily heated at 250° C. for 16 hours to adequately remove $NH_3$, water and ethanol. Then, 10.0 g of the silica particles thus obtained and 0.7 g of a solution of NaOH in ethylene glycol (NaOH concentration: 1.8%) were added to 18.7 g of silicone oil (Toray silicone SH200, 10cs), and the mixture was dispersed and mixed for 12 hours in a ball mill. The initial viscosity of the fluid thus obtained was 0.8 poise, and when an electric field of 2 kv/mm was applied, the viscosity increased to 17 poise (162 $sec^{-1}$).

EXAMPLE 6

20.0 g of spherical silica particles as used in Example 1 were added to 37.1 g of dioctyl adipate ($C_8H_{17}OOC(CH_2)_4COOC_8H_{17}$), and the mixture was dispersed and mixed for 12 hours in a ball mill. The initial viscosity of the fluid thus obtained was 0.6 poise, and when an electric field of 2 kv/mm was applied, the viscosity increased to 25 poise (162 $sec^{-1}$).

EXAMPLE 7

20.0 g of spherial silica particles as used in Example 1 were added to 39.4 g of dioctyl phthalate

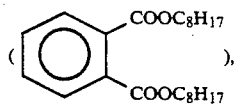

and the mixture was dispersed and mixed for 12 hours in a ball mill. The initial viscosity of the fluid thus obtained was 1.1 poise, and when an electric field of 2 kv/mm was applied, the viscosity increased to 37 poise (162 $sec^{-1}$).

EXAMPLE 8

20.0 g of spherical silica particles as used in Example 1 were added to a mixture of 7.0 g of a hydrocarbon-type low viscosity mineral oil (Mitsubishi Oil RO−2, 2cs) and 33.4 g of silicone oil (Toray SH200, 5cs), and the mixture was dispersed and mixed for 12 hours in a ball mill. The initial viscosity of the fluid thus obtained was 0.2 poise, and when an electric field of 2 kv/mm was applied, the viscosity increased to 11 poise (162 $sec^{-1}$).

EXAMPLE 9

Spherical silica particles as used in Example 1 were preliminarily heated at 250° C. for 16 hours to adequately remove $NH_3$, water and ethanol. Then 10.0 g of silica particles thus obtained, and 0.8 g of aqueous ammonia ($NH_3$concentration: 28 % by weight) were added to 18.7 g of silicone oil (Toray silicone SH200, 10cs ), and the mixture was dispersed and mixed for 12 hours in a ball mill. The initial viscosity of the fluid thus obtained was 0.2 poise, and when an electric field of 1.8 kv/mm was applied, the viscosity increased to 17 poise (365 $sec^{-1}$).

COMPARATIVE EXAMPLE 1

Spherical silica particles as used in Example 1 were preliminarily heated at 250° C. for 16 hours to adequately remove $NH_3$, water and ethanol. Then, 10.0 g of the silica particles thus obtained were added to 18.7 g of silicone oil (Toray silicone SH200, 10cs), and the mixture was dispersed and mixed for 12 hours in a ball mill. The electroviscous effect was measured with respect to the fluid thus obtained, whereby no increase in the viscosity was observed.

COMPARATIVE EXAMPLE 2

Spherical silica particles as used in Example 1 were preliminarily heated at 250° C. for 16 hours to adequately remove $NH_3$ , water and ethanol. To 10.0 g of silica particles thus obtained, 10.0 g of distilled water was added, followed by vacuum drying to obtain particles having a water content of 6.8%. Then, 10.0 g of the particles were added to 18.7 g of silicone oil (Toray silicone SH200, 10cs), and the mixture was dispersed and mixed for 12 hours in a ball mill. The electroviscous effect was measured with respect to the fluid thus obtained, whereby no increase in the viscosity was observed.

COMPARATIVE EXAMPLE 3

Pulverized silica gel was used instead of spherical silica particles in Example 3, (diameter: 63–200μm, the standard deviation: 1.9) and the electroviscous effect was measured, whereby discharge took place when an electric field of 0.5 kv/mm was applied, and subsequent measurement could not be conducted.

COMPARATIVE EXAMPLE 4

Silica gel used in Comparative Example 3 (diameter: 63–200μm, the standard deviation: 1.9) was further pulverized with water as solvent for 120 hours in an alumina ball mill, and filtered and dried in a vacuum (150° C.-2 hours). The silica gel thus obtained (diameter: 0.1–20μm, the standard deviation: 1.8) was used instead of spherical silica particles in Example 9, and the electroviscous effect was measured, whereby discharge took place when an electric field of 1.6 kv/mm was applied, and subsequent measurement could not be conducted.

COMPARATIVE EXAMPLE 5

Two types of spherical silica particle diameter: 0.6 μm, the standard deviation: 1.05 and average diameter: 0.9 μm, the standard deviation: 1.05) were obtained in the same manner as in Example 1. The two types of silica particles were mixed in 50% by weight, respectively, to obtain silica particles having average diameter of 0.75 μm and the standard deviation from the particle diameter of 1.35. The electroviscous effect was measured by using the silica particles thus obtained in the same manner as in Example 3 except that 6% by weight of aqueous ammonia was used. When an electric field of 2 kv/mm was applied, the viscosity was 16 poise and the current density was 95 $\mu A \cdot cm^{-2}$.

In contrast, silica particles (average diameter: 0.6 μm, the standard deviation: 1.05) were used instead of the above particles, and the electroviscous effect was measured, whereby the viscosity was 15 poise and the current density was 20 $\mu A \cdot cm^{-2}$ when an electric field of 2 kv/mm was applied.

As is evident from the above fact, if the standard deviation of spherical silica particles is more than 1.2, the current density thereof becomes too large whereby current efficiency will be bad, even though spherical silica particles are used.

As described in the forgoing, the present invention provides an electroviscous fluid having high stability as compared with the compositions disclosed in the prior art.

We claim:

1. An electroviscous fluid comprising an electrical insulating liquid, an electrolytic solution and particles of 0.05 to 2μm diameter dispersed therein, wherein said particles are spherical particles having a standard deviation in diameter of not more than 1.2 obtained by hydrolysis and polycondensation of a metal alkoxide selected from the group consisting of Si, Ti, Zr, Ba-Ti, Sr-Ti, Pb-Ti, Pb-Ti-Zr and Li-Nb.

2. The electroviscous fluid according to claim 1, wherein the electrolytic solution comprises of a polar solvent having a higher boiling point than water.

3. The electroviscous fluid according to claim 2, wherein the polar solvent is ethylene glycol.

4. The electroviscous fluid according to claim 1, wherein the electrolytic solution has an electrolyte concentration of from 0.1 to 90% by weight, and the electrolytic solution contained in the spherical particles is in an amount of from 0.1 to 20 % by weight.

5. The electroviscous fluid according to claim 1, 2 or 3 wherein the electrolytic solution has an electrolyte concentration of from 5 to 50 % by weight, and the electrolytic solution contained in the spherical particles is in an amount of from 1 to 10 % by weight.

6. The electroviscous fluid according to claim 1 wherein the amount of the fine particles in the electroviscous fluid is from 5 to 50 %.

7. The electroviscous fluid according to claim 1, wherein the metal alkoxide comprises lower alkoxy groups.

8. The electroviscous fluid according to claim 1 wherein, the metal alkoxide is silicone tetraethoxide.

9. The electroviscous fluid according to claim 4, wherein the electrolyte is at least one member selected from the group consisting of $NH_3$, NaOH, NaCl, LiCl, $B_2O_3$, $Ca(OH)_2$, $MgSO_4$, $Fe(SO_4)_2$, sodium sulfonate, sodium carboxylate, sodium alkylbenzene sulfonate, sodium polystyrene sulfonate, calcium salt of fatty acid and condensation product of naphthalene sulfonic acid with formalin.

10. The electroviscous fluid according to claim 1, wherein the standard deviation from the particle diameter is not more than 1.1 .

* * * * *